US007007870B2

(12) United States Patent
Noller et al.

(10) Patent No.: US 7,007,870 B2
(45) Date of Patent: Mar. 7, 2006

(54) FUEL INJECTION VALVE

(75) Inventors: Klaus Noller, Oppenweiler (DE); Martin Buehner, Backnang (DE)

(73) Assignee: Robert Bosch GmbH, Stuttgart (DE)

( * ) Notice: Subject to any disclaimer, the term of this patent is extended or adjusted under 35 U.S.C. 154(b) by 21 days.

(21) Appl. No.: 10/474,965

(22) PCT Filed: Dec. 23, 2002

(86) PCT No.: PCT/DE02/04732

§ 371 (c)(1),
(2), (4) Date: Apr. 7, 2004

(87) PCT Pub. No.: WO03/072928

PCT Pub. Date: Sep. 4, 2003

(65) Prior Publication Data

US 2004/0155124 A1 Aug. 12, 2004

(30) Foreign Application Priority Data

Feb. 26, 2002 (DE) ..... 102 08 224

(51) Int. Cl.
*B05B 1/30* (2006.01)

(52) U.S. Cl. ..... 239/585.5

(58) Field of Classification Search ..... 239/585.1, 239/585.4, 585.5

See application file for complete search history.

(56) References Cited

U.S. PATENT DOCUMENTS 4,766,405 A 8/1988 Daly et al.

FOREIGN PATENT DOCUMENTS

| | | | |
|---|---|---|---|
| DE | 199 50 761 | | 4/2001 |
| DE | 100 39 078 | | 2/2002 |
| DE | 101 18 162 | | 10/2002 |
| DE | 101 24 743 | | 11/2002 |
| WO | WO01/29402 | * | 4/2001 |
| WO | WO 02 12709 | | 2/2002 |
| WO | WO 02 084102 | | 10/2002 |
| WO | WO 02 095215 | | 11/2002 |

* cited by examiner

*Primary Examiner*—Christopher Kim
(74) *Attorney, Agent, or Firm*—Kenyon & Kenyon

(57) ABSTRACT

A fuel injector, in particular for the direct injection of fuel into the combustion chamber of an internal combustion engine, includes a valve needle, which cooperates with a valve seat surface to form a sealing seat, and an armature engaging with the valve needle. The armature is arranged on the valve needle in an axially movable manner and damped by a damping element made of an elastomer. Arranged between the armature and the damping element is an intermediate ring, and the damping element rests on a flange that is connected to the valve needle by force locking. Due to the intermediate ring, the armature is supported on the valve needle in a twist-proof manner.

7 Claims, 2 Drawing Sheets

FUEL INJECTION VALVE

BACKGROUND INFORMATION

U.S. Pat. No. 4,766,405 describes a fuel injector which has a valve-closure member connected to a valve needle, the valve-closure member cooperating with a valve seat surface formed on a valve seat element to form a sealing seat. A magnetic coil is provided for the electromagnetic actuation of the fuel injector, the magnetic coil cooperating with an armature that is connected to the valve needle by force-locking. Surrounding the armature and the valve needle is an additional mass, which has a cylindrical shape and is connected to the armature via an elastomeric layer.

The disadvantage with this is particularly the costly design with an additional component. In addition, the large-surfaced elastomer ring is disadvantageous for the pattern of the magnetic field and hinders the closing of the field lines, and thus the achievement of high attractive forces during the opening movement of the fuel injector.

SUMMARY OF THE INVENTION

The fuel injector according to the present invention has the advantage over the related art that the armature is arranged in a twist-proof manner with respect to the intermediate ring and the damping element, without this requiring additional components. The further functions, such as debouncing of the armature and the valve needle, and the draining of fuel from the sealing element, remain unaffected.

The intermediate ring is preferably positioned in a recess formed in a discharge-side end face of the armature.

Since sides are formed on the intermediate ring, it is easy to achieve an engagement of the intermediate ring with the fuel channels into which the recess cuts, so that the intermediate ring abuts against the corners formed thusly, in a pointwise manner, and is unable to twist relative to the armature.

A variant of an embodiment provides for the armature and the intermediate ring to be joined directly to one another in a simple and inexpensive way, by welding.

It is also advantageous that the components armature and intermediate ring, which engage with, or are joined to, one another, are arranged on the valve needle in a twist-proof manner, due to the static friction prevailing between the damping element and the intermediate ring.

DETAILED DESCRIPTION

Figure 1:
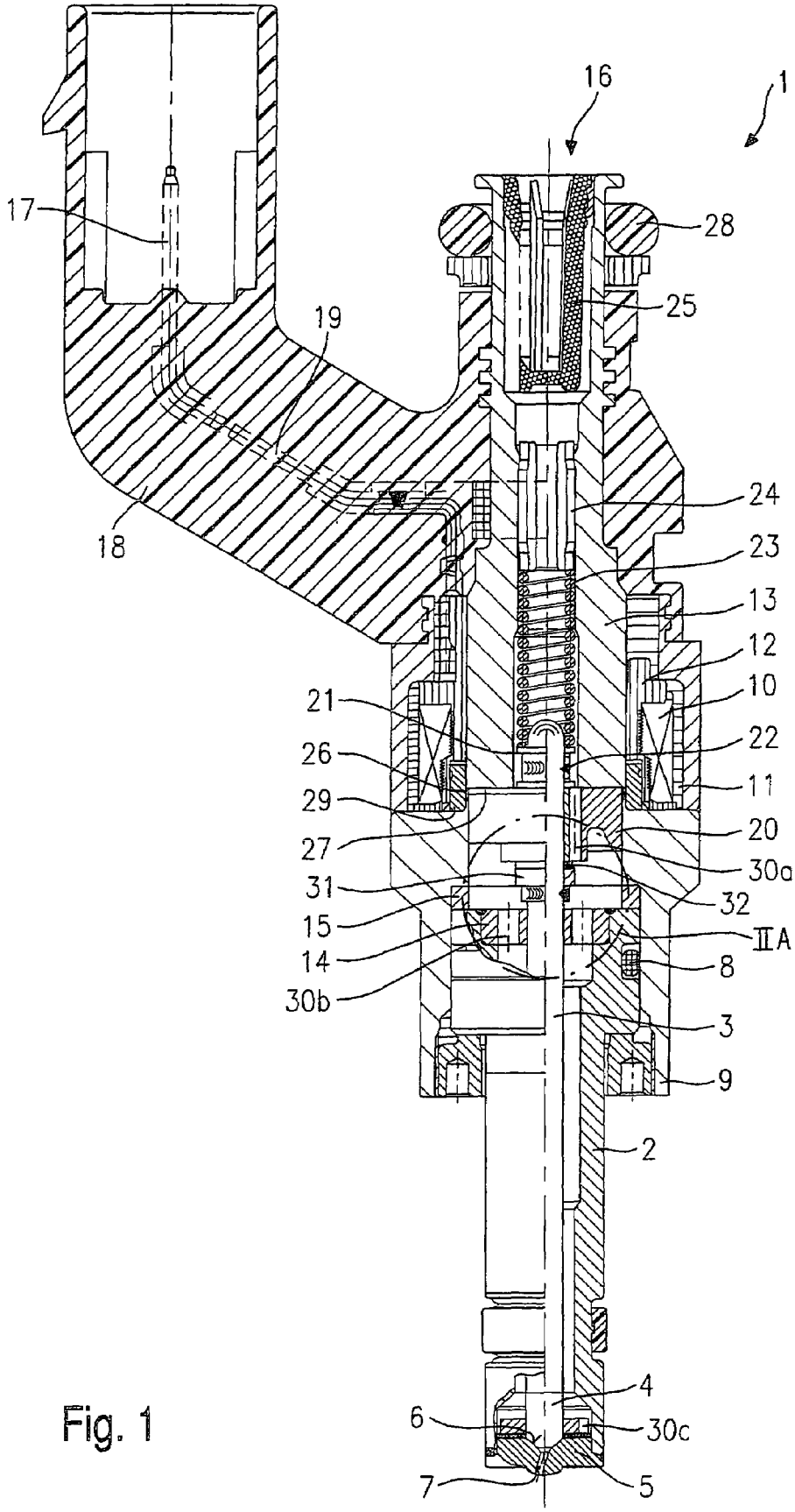
FIG. 1 shows a schematic section through an exemplary embodiment of a fuel injector configured according to the present invention.
Figure 2A:
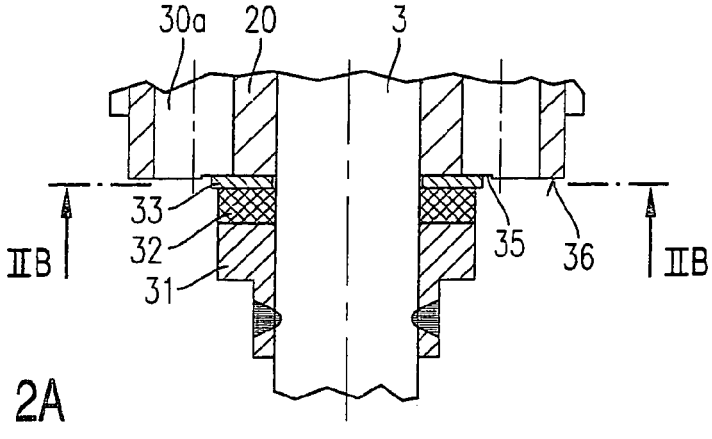
FIG. 2A shows a schematic longitudinal section through the fuel injector designed according to the present invention, in area IIA in FIG. 1.
Figure 2B:
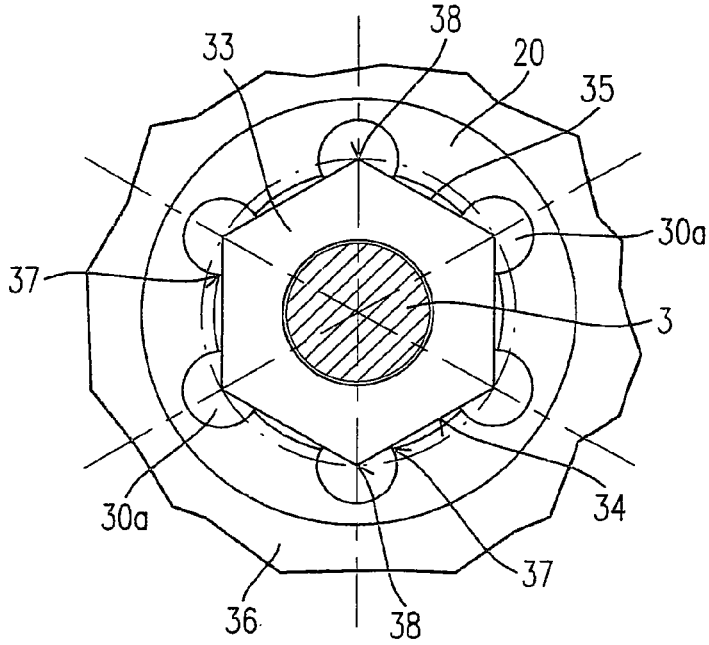
FIG. 2B shows a section along the line IIB—IIB in FIG. 2A.
Figure 3:
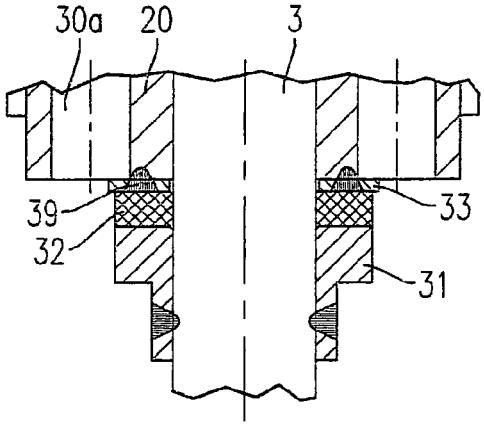
FIG. 3 shows a schematic longitudinal section through another exemplary embodiment of a fuel injector designed according to the present invention, in region IIA in FIG. 1.

Before giving a more detailed description, based on FIGS. 2A, 2B and 3, of exemplary embodiments of a fuel injector 1 according to the present invention, to provide a better understanding of the present invention, a fuel injector shall first of all be explained briefly in terms of its important components with reference to FIG. 1.

Fuel injector 1 is configured in the form of a fuel injector for fuel-injection systems of mixture-compressing internal combustion engines with externally supplied ignition. Fuel injector 1 is suited, in particular, for the direct injection of fuel into a combustion chamber (not shown) of an internal combustion engine.

Fuel injector 1 is made up of a nozzle body 2 in which a valve needle 3 is positioned. Valve needle 3 is in operative connection to valve-closure member 4, which cooperates with a valve-seat surface 6 positioned on a valve-seat member 5, to form a sealing seat. In the exemplary embodiment, fuel injector 1 is an inwardly opening fuel injector 1, which has one spray-discharge orifice 7. Nozzle body 2 is sealed from outer pole 9 of a magnetic coil 10 by a seal 8. Magnetic coil 10 is encapsulated in a coil housing 11 and wound on a coil brace 12, which rests against an inner pole 13 of magnetic coil 10. Inner pole 13 and outer pole 9 are separated from one another by a constriction 26 and interconnected by a non-ferromagnetic connecting part 29. Magnetic coil 10 is energized via a line 19 by an electric current that may be supplied via an electrical plug contact 17. A plastic extrusion coat 18, which may be extruded onto inner pole 13, encloses plug contact 17.

Valve needle 3 is guided in a valve-needle guide 14, which is disk-shaped. A paired adjustment disk 15 is used to adjust the (valve) lift. On the other side of adjustment disk 15 is an armature 20 which, via a first flange 21, is connected by force-locking to valve needle 3, which is connected to first flange 21 by a welding seam 22. Braced on first flange 21 is a restoring spring 23 which, in the present design of fuel injector 1, is prestressed by a sleeve 24. Fuel channels 30*a* through 30*c* run in valve-needle guide 14, in armature 20 and on valve-seat member 5. The fuel is supplied via a central fuel feed 16 and filtered by a filter element 25. A seal 28 seals fuel injector 1 from a fuel line (not shown further).

On the spray-discharge side of armature 20 is an annular damping element 32 made of an elastomeric material. It rests on second flange 31, which is connected by force-locking to valve needle 3. According to the present invention, fuel injector 1 has an intermediate ring 33 between damping element 32 and armature 20, which is designed and arranged in such a way that a twisting of armature 20 during operation of fuel injector 1 is prevented. A detailed representation and description of the measures of the present invention can be gathered from FIGS. 2A and 2B as well as FIG. 3.

In the rest state of fuel injector 1, armature 20 is acted on by restoring spring 23, in a direction opposite to its lift direction, in such a manner that valve-closure member 4 is sealingly held against valve seat 6. In response to excitation of magnetic coil 10, it generates a magnetic field that moves armature 20 in the lift direction, counter to the spring force of restoring spring 23, the lift being predefined by a working gap 27 which occurs in the rest position between inner pole 12 and armature 20. First flange 21, which is welded to valve needle 3, is taken along by armature 20, in the lift direction as well. Valve-closure member 4, being in connection with valve needle 3, lifts off from valve seat surface 6, and the fuel is spray-discharged through spray-discharge orifice 7.

When the coil current is switched off, after sufficient decay of the magnetic field, armature 20 falls away from inner pole 13 because of the pressure of restoring spring 23, whereupon flange 21, which is connected to valve needle 3, moves in a direction counter to the lift. Valve needle 3 is thereby moved in the same direction, causing valve-closure member 4 to set down on valve seat surface 6 and fuel injector 1 to be closed.

FIG. 2A shows an enlarged part-sectional view of region IIA in FIG. 1.

Shown is a part of valve needle 3, second flange 31 welded thereto, and the lower part of armature 20 with fuel channel 30*a* extending therein. Damping element 32 lies on top of second flange 31. According to the present invention, the first exemplary embodiment shown in FIG. 2A has an intermediate ring 33, which is arranged between a discharge-side armature surface 35 and damping element 32. Due to the low static friction between metallic armature 20 and the likewise metallic intermediate ring 33, armature 20 could twist uncontrollably during operation of fuel injector 1 were it not for the measures according to the present invention. Over time, the rotations cause wear manifestations to appear, which lead to changes in the valve travel of armature 20, the height of lift of valve needle 3 or even to jamming of armature 20 with subsequent malfunctions of fuel injector 1.

According to the present invention, intermediate ring 33 is therefore formed and arranged in such a way that armature 20 is supported on valve needle 3 in a twist-proof manner, and may only move axially within the framework of the armature stops, which are formed by first flange 21 and second flange 31.

In the exemplary embodiment shown in FIGS. 2A and 2B, intermediate ring 33 has a polygonal form, which results from segments being removed from the originally round intermediate ring 33. In the present first exemplary embodiment, the number of sides 34 is six, as can be inferred from FIG. 2B, which shows a sectioned view along the line designated IIB-IIB in FIG. 2A.

To prevent armature 20 from twisting relative to intermediate ring 33, it is necessary furthermore to insert it inside armature 20, in a recess 35, which can be seen in FIG. 2A in a discharge-side end face 36 of armature 20. The diameter of recess 35 is somewhat smaller than the original diameter of intermediate ring 33 prior to introducing sides 34. In this way, fuel channels 30*a*, formed in armature 20, are cut into, thereby forming corners 37 at which sides 34 of intermediate ring 33 abut point-for-point. Because of the fact that one corner 38 of intermediate ring 33 in each case engages with a fuel channel 30*a* cut into in this way, intermediate ring 33 is unable to twist relative to armature 20.

Since intermediate ring 33, on the other side, rests against damping element 32, which is made of an elastomeric material, the static friction between intermediate ring 33 and damping element 32 is so great that they are unable to twist relative to one another.

FIG. 3 shows a second exemplary embodiment of a development of fuel injector 1 according to the present invention, in the same view as FIG. 2A. Identical components have been provided with matching reference numerals.

In contrast to the first exemplary embodiment shown in FIGS. 2A and 2B, in the present second exemplary embodiment the anti-twisting fixation of armature 20 relative to intermediate ring 33 is achieved by at least one welding spot 39, preferably a circumferential welding seam. This is advantageous insofar as it allows a simple and inexpensive manufacture. Welded spot 39 may extend across the entire circumference of intermediate ring 33. A plurality of welded spots may also be limited, for example, to individual points, such as points between fuel channels 30*a*.

The present invention is not limited to the exemplary embodiments shown, but is also suited, for instance, for outwardly opening fuel injectors 1 and other armature designs, such as flat armatures.

What is claimed is:

1. A fuel injector comprising:

a valve-seat surface;

a valve needle cooperating with the valve-seat surface to form a sealing seat;

an armature engaging with the valve needle, the armature being axially movable on the valve needle;

a flange joined to the valve needle by force locking;

a damping element composed of an elastomer, the damping element damping the armature, the damping element resting on the flange; and an intermediate ring situated between the armature and the damping element, wherein the armature, due to the intermediate ring, is supported on the valve needle in a twist-proof manner;

wherein the intermediate ring is at least partially situated in a recess in a downstream-side end face of the armature;

wherein the intermediate ring has a polygonal form;

wherein the polygonal intermediate ring, by way of corners formed by the sides, engages with fuel channels cut into by the recess.

2. The fuel injector according to claim 1, wherein the fuel injector is configured for providing direct injection of fuel into a combustion chamber of an internal combustion engine.

3. The fuel injector according to claim 1, wherein a number of sides of the intermediate ring is equal to a number of fuel channels in the armature.

4. The fuel injector according to claim 3, wherein the number of sides is six.

5. The fuel injector according to claim 1, wherein the cut-into fuel channels abut against sides of the intermediate ring by way of corners.

6. The fuel injector according to claim 1, wherein the intermediate ring is connected to the armature via at least one welded spot.

7. The fuel injector according to claim 1, wherein the intermediate ring is held on the damping element in a twist-proof manner by static friction.

* * * * *